United States Patent [19]

Kent et al.

[11] Patent Number: 4,498,935

[45] Date of Patent: Feb. 12, 1985

[54] ZINC PHOSPHATE CONVERSION COATING COMPOSITION

[75] Inventors: Gary D. Kent, Sterling Heights; Norbert B. Intorp, Farmington Hills; Thomas H. Springstead, Pontiac, all of Mich.

[73] Assignee: Parker Chemical Company, Madison Heights, Mich.

[21] Appl. No.: 282,480

[22] Filed: Jul. 13, 1981

[51] Int. Cl.[3] ..... C23F 7/10

[52] U.S. Cl. ..... 148/6.15 Z

[58] Field of Search ..... 148/6.15 Z, 6.15 R

[56] References Cited

U.S. PATENT DOCUMENTS 2,295,545 9/1942 Clifford et al. ..... 148/6.15 Z
3,146,133 8/1964 Lantoin ..... 148/6.15 Z
3,272,664 9/1966 Schlossberg et al. ..... 148/6.15 R
4,292,096 9/1981 Murakami ..... 148/6.15 Z

FOREIGN PATENT DOCUMENTS 1542222 3/1979 United Kingdom .

OTHER PUBLICATIONS

Wiederholt, The Chemical Surface Treatment of Metals, Robert Draper Ltd, Teddington, 1965, pp. 80–83.

*Primary Examiner*—Sam Silverberg
*Attorney, Agent, or Firm*—Arthur E. Kluegel

[57] ABSTRACT

An aqueous acidic zinc phosphate coating composition for treating a metal surface to provide a conversion coating thereon, the composition comprising chlorate anion and an aromatic nitro anion in a weight ratio of less than 2:1 to about 1:10.

16 Claims, No Drawings

ZINC PHOSPHATE CONVERSION COATING COMPOSITION

BACKGROUND OF THE INVENTION

The present invention relates to a coating composition and its method of use for treating metal surfaces to apply a zinc phosphate conversion coating thereon. More particularly, the present invention relates to a zinc phosphate conversion coating composition which contains an accelerator system comprising chlorate anion and an aromatic nitro anion. The chlorate anion and aromatic nitro anion are employed within a weight ratio range of from less than 2:1 to about 1:10 to provide an improved, economical zinc phosphate coating composition which has low sludge and scale characteristics and which can be applied to a metal surface under low temperature conditions to provide an improved zinc phosphate conversion coating thereon.

The use of zinc phosphate conversion coatings as a surface pretreatment to prepare a metal surface for painting is well known. Conversion coating involves a non-electrolytic process which converts a purely metallic surface to an inorganic crystallinecoated surface having increased surface area and energy. The benefits offered by conversion coating include better paint adhesion over a longer period of time, increased corrosion resistance and generally improved paint durability.

Early processes for conversion coating required several hours of process time and provided only a small improvement in corrosion resistance. However, in recent years accelerators have been discovered which can be added to treatment solutions to reduce process times for conversion coating to a matter of seconds. Among accelerators which have been disclosed as useful in metal coating compositions are oxidizing agents such as are taught in U.S. Pat. Nos. 3,682,713 and 3,146,133; Canadian Pat. No. 698,386 and British Pat. No. 1,542,222, including agents such as chlorate and sodium m-nitrobenzenesulfonate which have even been used commercially. Heretofore, however, it was taught that chlorate and sodium m-nitrobenzenesulfonate should be used in relatively high weight ratios, e.g. from 2:1 to about 10:1.

As will be appreciated by those skilled in the art, corrosion resistance testing requires extended time periods even under accelerated conditions and accurate predictive testing procedures are difficult to define. As a result, coating compositions offering improved performance can be difficult to identify. Furthermore, although zinc phosphate coating compositions containing an aromatic nitro compound such as m-nitrobenzenesulfonate, and a chlorate can provide satisfactory performance in metal surface pretreatment, for some uses there remains a need for an improved zinc phosphate coating composition which economically offers performance improvements with regard to corrosion resistance and physical properties such as impact resistance, chip resistance, paint adhesion, and bend impact adhesion.

Wherefore, an improved zinc phosphate conversion coating composition has now been discovered wherein an accelerator system comprises chlorate anion and an aromatic nitro anion such as m-nitrobenzenesulfonate within a novel weight ratio range. A coating composition of the present invention provides an economical low sludge, low scale, low temperature zinc phosphate conversion coating having improved corrosion resistance and physical properties, especially when used under cathodic electrodeposition primer on steel, aluminum and galvanized surfaces.

SUMMARY OF THE INVENTION

An aqueous zinc phosphate conversion coating solution of the present invention comprises an accelerator system of chlorate anion and an aromatic nitro anion in a weight ratio of from less than 2:1 to about 1:10, preferably from about 1.25:1 to about 1:2 and more preferably about 1:1. The present invention includes the working solution, the conversion coating process of its use and concentrates for its making and replenishment.

DESCRIPTION OF THE INVENTION

An aqueous zinc phosphate conversion coating solution of the present invention comprises zinc ions and phosphate ions, and an accelerator system comprising chlorate anion and an aromatic nitro anion, preferably m-nitrobenzenesulfonate ion, in a ratio of less than 2:1 to about 1:10, preferably from about 1.25:1 to about 1:2 and more preferably about 1:1. As used herein, all "ratios", "percentages", and "parts" are by weight unless otherwise specified. Of course, the coating solution can also contain optional further ingredients, for example, nitrate ion, which are conventional in the art for use in such solutions. In addition, if the coating solution is intended for use on an aluminum surface, the coating solution should contain fluoride ion. For use on a galvanized surface, the coating solution should contain fluoride ion and one of nickel, cobalt or iron ions or a combination thereof.

A working solution of the coating composition of the present invention is an acidic aqueous solution comprising:

(A) from about 0.05% to about 2.5%, preferably from about 0.10% to about 0.40%, zinc ion;

(B) from about 0.15% to about 7.5%, preferably from about 0.3% to about 1.2% phosphate ion;

(C) from about 0.05% to about 5%, preferably from about 0.15% to about 0.7% of an aromatic nitro anion; and (D) from about 0.05% to about 5%, preferably from about 0.15% to about 0.7% chlorate ion;

and wherein the ratio of chlorate anion to aromatic nitro anion is less than 2:1 to about 1:10, preferably from about 1.25:1 to about 1:2, and more preferably is about 1:1.

Preferably, the working solution also comprises, in addition to the above ingredients, from about 0.2% to about 0.9% nitrate ion. For use on aluminum metal surfaces the working solution should comprise from about 0.02% to about 0.1% fluoride ion which can be present in the solution as free fluoride ion in equilibrium with complex fluorides such as fluoroborates and/or fluorosilicates. For use on galvanized metal surfaces the solution should comprise from about 0.01% to about 0.25% of a metal ion selected from the group consisting of nickel, cobalt, and iron ions and mixtures thereof as a metal accelerator, in addition to from about 0.02% to about 0.4% fluroide ion which can be present in solution as free fluoride ion in equilibrium with complex fluorides such as fluoroborates and/or fluorosilicates. Additionally, the working solution can be used with mixtures of metal surfaces (steel, galvanized steel, and aluminum). In this case the solution should contain from about 0.01% to 0.25% metal ion selected from the group consisting of nickel, cobalt, and iron ions and mixtures thereof as a metal accelerator and/or from about 0.02% to about 0.1% fluoride ion which can be present in solution as free fluoride ion in equilibrium with complex fluoride; i.e. fluoroborates and/or fluorsilicate.

The operating solution should have a pH of from about 2 to about 3.5, preferably from about 2.9 to about 3.2. Also, the solution should contain from about 5 to about 100, preferably from about 9 to about 30, points total acid and should contain from about 0.3 to about 20, preferably from about 0.6 to 2.5, points free acid. The solution can have a temperature between about 80° F. and 160° F., preferably between about 100° F. and 120° F. The points acid are defined in the customary way as the amount in ml of 0.1N NaOH which is necessary to titrate 10 ml of solution to the turning point of bromophenol blue (free acid) or phenolphthalein (total acid). It will, of course, be appreciated that these acid values can also be determined by means of a suitable pH meter to determine end point in potentiametric titrations.

The ingredients of the operating solution can be introduced by adding suitable water soluble salts or acids to the working solution. Thus, the aromatic nitro anion can be provided by a water soluble aromatic nitro compound. Suitable aromatic nitro compounds are water soluble and have no more than two nitro groups, for example, nitrobenzoic acid. The preferred anion is m-nitrobenzenesulfonate ion. Zinc and phosphate ions can be introduced into the solution in a conventional manner by use of compounds such as zinc nitrate, zinc oxide, zinc carbonate, zinc acid phosphate, phosphoric acid, monosodium phosphate and disodium phosphate. Chlorate ion can be introduced in the solution by addition of an alkali metal salt thereof such as sodium chlorate.

As is the usual commercial practice, a liquid concentrate or concentrates may be first made and then diluted to form a working solution. The free acid content of the concentrate can, of course, be adjusted in a conventional manner to avoid forming a precipitate in the concentrate during storage. It is contemplated that, in practice, the working solution will generally be made up and then replenished during its use over time with suitable amounts of the starting materials and adjusting to maintain the proper pH and acid content. The operating solution can be replenished by addition of one replenishing solution containing all ingredients to be added or two or more replenishing solutions which, in combination contain all ingredients to be added. For example, one replenishing solution might contain zinc and phosphate and optionally nitrate and/or fluoride and/or nickel while another replenishing solution contains alkali, m-nitrobenzenesulfonate, and chlorate.

In use, the working solution of the present invention will be applied to a steel, aluminum or galvanized metal surface as the conversion coating step of a metal pretreatment process. A typical metal pretreatment process consists of the steps of cleaning, rinsing, conversion coating, rinsing, post treatment, and rinsing with deionized water. It is contemplated that the pretreatment process will be followed by a painting or other coating step as is conventional in the metal finishing art. For example, the present invention has been found to be especially useful in a metal pretreatment process which is followed by application of a cathodic electrodeposition primer.

The working solution will generally be applied to the metal surface by spraying or immersion or a combination of spraying and immersion. Whatever method is used, the working solution must be in contact with the metal surface for a sufficient period of time to effectively apply the desired conversion coating thereon. The exact time will, of course, vary depending upon the process conditions and particular metal to be conversion coated. Typically, the metal surface should be in contact with the operating solution for about ½ to 3 minutes. As with other conversion coatings, this coating is self-limiting in nature and, hence is tolerant to excessive treatment time. Coating weights of this invention will range from about 80 to 150 mg/ft$^2$ on steel, about 120 to 200 mg/ft$^2$ on galvanized, and up to about 40 mg/ft$^2$ on aluminum.

The working solution and process of the present invention convert the treated metallic surface to a finely crystalline, zinc phosphate conversion coating. The conversion coatings offer performance improvements with regard to receptivity of paint, corrosion resistance and physical properties. In particular, a conversion coating of the present invention exhibits improved corrosion resistance and physical properties when used under cathodic electrodeposition primer on steel, aluminum or galvanized surfaces. The coating solution is further characterized by reduced sludge and scale in the working solution. The present invention is thus useful not only in the automotive industry but also in metal finishing generally.

The following Examples further illustrate the present invention.

EXAMPLE I

A concentrate "A" is prepared by mixing the following materials in a stainless steel mixing tank:

| material | parts by weight |
|---|---|
| water | 230.7 |
| sodium silicate | 1.2 |
| zinc oxide | 100.0 |
| nitric acid, 42° Be | 122.0 |
| hydrofluorosilica acid, 30% | 42.7 |
| phosphoric acid, 75% | 433.0 |
| nickel nitrate solution, 13.4% Ni, 29% $NO_3$ | 69.4 |

A concentrate "B" is prepared by adding with mixing the following materials to a stainless steel mixing tank:

| material | parts by weight |
|---|---|
| sodium chlorate | 100.0 |
| sodium m-nitrobenzenesulfonate | 100.0 |
| water | 800.0 |

A working solution is then prepared by mixing 42 g of the concentrate A and 29.2 g of concentrate B, and 1.2 g soda ash to a total volume of 1.0 liters for spray application. The total acid is about 13 points at build-up as determined using a 10 ml sample versus N/10 sodium hydroxide to phenolphthalein endpoint.

EXAMPLE II

A 4"×12"×24 gauge, unpolished cold rolled steel panel is processed as follows:

(1) cleaned with an alkaline cleaner, Parco Cleaner 348 (from the Parker Division of Oxy Metal Industries) ½ oz./gal. 140° F., spray for 1 minute;
(2) rinsed with warm water spray for 30 seconds;
(3) contacted with the working solution of Example I at 120° F., spray for 1 minute;
(4) rinsed with cold water, spray for 30 seconds;
(5) rinsed with a chromic acid rinse Parcolene 60 (from the Parker Division of Oxy Metal Industries) Conc. 4.0 pts., pH 4.0, room temperature; immersion for 30 seconds;
(6) rinsed with deionized water, spray for 10 seconds; and
(7) oven dried ⅝ 350° F. for 5 minutes.

EXAMPLE III

Several panels are treated as in Example II and then are painted with ED3002R, a cathodic electropaint from PPG. The panels are then subjected to corrosion testing and testing of physical properties and found to have excellent corrosion resistance and physical properties.

EXAMPLE IV

Example III is carried out except that temper rolled galvanized panels are substituted for the steel panels of Example II. Similar results are obtained.

EXAMPLE V

Example III is carried out except that aluminum panels are substituted for the steel panels of Example II. Similar results are obtained.

EXAMPLE VI

Examples III through V are carried out except that in each case step (3) of Example II is carried out by immersion of the panel in the working solution at 120° F. for 1 minute. In each case similar results are obtained.

What is claimed is:

1. An aqueous zinc phosphate conversion coating solution comprising:
(A) from about 0.05% to about 2.5% zinc ions;
(B) from about 0.15% to about 7.5% phosphate ions;
(C) from about 0.05% to about 5.0% aromatic nitro anion having no more than two nitro groups; and
(D) from about 0.05% to about 5.0% chlorate anion, wherein the ratio of said chlorate anion to said aromatic nitro anion is from less than about 2:1 up to about 1:2.

2. A conversion coating solution as in claim 1 wherein said ratio is from about 1.25:1 to about 1:2.

3. A conversion coating solution as in claim 1, wherein said aromatic nitro anion is m-nitrobenzenesulfonate.

4. A conversion coating solution as in claim 3 wherein said solution comprises:
(A) from about 0.10% to about 0.40% zinc ion;
(B) from about 0.3% to about 1.2% phosphate ion;
(C) from about 0.15% to about 0.7% m-nitrobenzenesulfonate ion; and
(D) from about 0.15% to about 0.7% chlorate ion.

5. A conversion coating solution as in claim 4 wherein said ratio is from about 1.25:1 to about 1:2.

6. A conversion coating solution as in claim 1 wherein said solution comprises, in addition, from about 0.2% to about 0.9% nitrate ion.

7. A conversion coating solution as in claim 1 wherein said solution comprises, in addition, from about 0.02% to about 0.4% fluoride ion.

8. A conversion coating solution as in claim 1 wherein said solution comprises, in addition, from about 0.01% to about 0.25% of a metal ion selected from the group consisting of nickel, cobalt, iron and mixtures thereof.

9. A conversion coating solution as in claim 1 wherein said solution has a pH of from about 2 to about 3.5, has from about 5 to about 100 points total acid and from about 0.3 to about 20 points free acid.

10. A conversion coating solution as in claim 9 wherein said solution has a pH of from about 2.9 to about 3.2, has from about 9 to about 30 points total acid and from about 0.6 to about 2.5 points free acid.

11. A conversion coating solution as in claim 10 wherein said aromatic nitro anion is m-nitrobenzenesulfonate.

12. A conversion coating solution as in claim 11 wherein said ratio is from about 1.25:1 to about 1:2.

13. A conversion coating solution as in claim 12 wherein said ratio is about 1:1.

14. A process for treating a metal surface comprising contacting the surface with the composition of claim 1.

15. A process for treating a metal surface comprising contacting the surface with the composition of claim 4.

16. A process for treating a metal surface comprising contacting the surface with the composition of claim 9.

* * * * *

UNITED STATES PATENT AND TRADEMARK OFFICE

CERTIFICATE OF CORRECTION

PATENT NO. : 4,498,935

DATED : February 12, 1985

INVENTOR(S) : G. Kent; N. Intorp; T. Springstead

It is certified that error appears in the above–identified patent and that said Letters Patent are hereby corrected as shown below:

In column 5, line 15, please delete "5/8" and insert --at--.

Signed and Sealed this

Fourteenth Day of April, 1987

*Attest:*

DONALD J. QUIGG

*Attesting Officer*

*Commissioner of Patents and Trademarks*